United States Patent [19]

Biondetti

[11] Patent Number: 5,022,319

[45] Date of Patent: Jun. 11, 1991

[54] APPARATUS FOR NEUTRALIZING OVERHANGING LOADS

[75] Inventor: Mario Biondetti, Schio, Italy

[73] Assignee: Sulzer-Escher Wyss GmbH, Ravensburg, Fed. Rep. of Germany

[21] Appl. No.: 336,489

[22] Filed: Apr. 12, 1989

[51] Int. Cl.[5] ..... B30B 3/04

[52] U.S. Cl. ..... 100/170; 100/163 R; 100/168

[58] Field of Search ..... 100/170, 168, 163 R, 100/162 R, 161, 47, 169, 171

[56] References Cited

U.S. PATENT DOCUMENTS

| | | | |
|---|---|---|---|
| 2,474,512 | 6/1949 | Bechtold et al. | 100/170 X |
| 3,158,088 | 11/1964 | Seidel | 100/163 R |
| 3,196,615 | 7/1965 | Kautz | 100/170 X |
| 3,525,301 | 8/1970 | Justus et al. | 100/161 |
| 4,510,859 | 4/1985 | Berry | 100/47 X |
| 4,597,275 | 7/1986 | Schneid et al. | 100/47 X |
| 4,721,039 | 1/1988 | Lehmann | 100/163 R X |
| 4,736,678 | 4/1988 | Stotz | 100/170 X |
| 4,823,690 | 4/1989 | Stotz | 100/170 X |
| 4,890,551 | 1/1990 | Dahl et al. | 100/168 X |
| 4,924,772 | 5/1990 | Schlunke et al. | 100/163 R |

FOREIGN PATENT DOCUMENTS

| | | | |
|---|---|---|---|
| 345647 | 11/1920 | Fed. Rep. of Germany . | |
| 557242 | 10/1930 | Fed. Rep. of Germany . | |
| 915890 | 4/1944 | Fed. Rep. of Germany . | |
| 1052799 | 3/1959 | Fed. Rep. of Germany . | |
| 1150272 | 6/1963 | Fed. Rep. of Germany . | |
| 2101374 | 8/1972 | Fed. Rep. of Germany . | |
| 3004912 | 9/1981 | Fed. Rep. of Germany . | |
| 3702245 | 8/1988 | Fed. Rep. of Germany | 100/162 R |

*Primary Examiner*—Harvey C. Hornsby
*Assistant Examiner*—Stephen F. Gerrity
*Attorney, Agent, or Firm*—Sandler, Greenblum & Bernstein

[57] ABSTRACT

The apparatus for neutralizing overhanging loads is supported at the roll stand of a calender which opens in downward direction. This apparatus is arranged at both sides of a roll and, during operation, presses from below against the roll suspensions in a predetermined or required position of the roll. This is accomplished by a force which compensates for the overhanging loads. This force is generated or set by movable force transmitters, dimensionally deformable force transmitters or displaceable force transmitters. Upon opening the calender, a force greater than the set force acts upon the load neutralizing apparatus and the force transmitters are moved, dimensionally deformed or displaced, as the case may be, such that a displacement path of the roll into a lower lowered position is provided. The force transmitters for generating the force which compensates for the overhanging loads can be a spring assembly, an air spring or a column or head of liquid supported by a gas cushion.

4 Claims, 1 Drawing Sheet

APPARATUS FOR NEUTRALIZING OVERHANGING LOADS

CROSS-REFERENCE TO RELATED PATENTS AND PATENT APPLICATIONS

This application is related to the commonly assigned U.S. Pat. No. 4,736,678, granted Apr. 12, 1988, entitled: "APPARATUS FOR SELECTIVELY POSITIONING ROLLS IN A CALENDER ROLL STACK", U.S. Pat. No. 4,721,039, granted Jan. 26, 1988, entitled: "METHOD AND CONTROL APPARATUS FOR SEPARATING THE ROLLS OF A CALENDER", and U.S. Pat. No. 4,597,275, granted July 1, 1986, entitled: "CALENDER".

This application is also related to the commonly assigned, co-pending U.S. patent application Ser. No. 07/176,292, filed Mar. 31, 1988, entitled: "APPARATUS FOR GUIDING THE ROLLS OF AN ESSENTIALLY VERTICAL CALENDER" now U.S. Pat. No. 4,890,551, granted Jan. 2, 1990, and U.S. patent application Ser. No. 07/182,086, filed Apr. 15, 1988, entitled: "ROLL CALENDER WITH NIP RELIEVING DEVICES" now U.S. Pat. No. 4,823,690, granted Apr. 25, 1989.

BACKGROUND OF THE INVENTION

The present invention broadly relates to an apparatus for mutually positioning roll surfaces of rolls in a roll calender and, more specifically pertains to a new and improved apparatus for neutralizing overhanging or cantilever loads at rolls of a roll calender which is to be downwardly opened.

Generally speaking, the apparatus of the present invention is of the type which is supported at a roll stand of the roll calender, provided at both sides of the rolls or rollers and in each case presses against a related roll suspension in a predetermined or required position of the related roll or roller with a force which compensates for the overhanging or cantilever loads.

A calender which is known to the art comprises a number of intermediate rolls or rollers which are arranged between an uppermost roll or roller and a lowermost roll or roller. During operation, these intermediate rolls or rollers of the calender are pressed against one another by raising the lowermost roll or roller. The calender is opened by lowering the lowermost roll or roller and the intermediate rolls or rollers are lowered by their own weight into predetermined or desired spatial positions, the intermediate rolls or rollers assuming or retaining a defined spacing from one another. This lowering must be very rapidly accomplished, for example, in the event of an operational disturbance or breakdown. The working or operating pressure in the individual nips between the intermediate rolls or rollers results from the sum of the forces with which the individual intermediate rolls or rollers act from above and in the downward direction upon the respective lower roll or roller. In addition thereto, the so-called overhanging or cantilever loads deformingly act upon the axles or journals of the intermediate rolls or rollers. In this regard there is to be understood in terms of such loads all of the weight of the roll portions or sections on both sides of the material web to be treated, the weight of the journals of the rolls or rollers and of the bearings thereof, the weight of guide rollers possibly suspended thereat and the weight of finger protector devices and the like. These weights can amount at each side to 15 kN and more. The deforming action of such overhanging or cantilever loads is substantially prevented in that such overhanging or cantilever loads are counteracted by a corresponding force.

For this purpose, there are known support structures, in most cases hydraulic piston-and-cylinder units, by means of which the aforesaid corresponding force is set and retained. During the so-called "opening" or nip relieving of the roll calender, the hydraulic or pressurized fluid medium located in the cylinder must be expelled by means of a switching or control operation. The lowering displacement path of the intermediate rolls or rollers into the lowered position can be determined or given by the quantity of expressed or expelled hydraulic or pressurized fluid medium. However, a limit stop or impact member can also serve as a displacement path limitation facility.

These known support structures or units perform satisfactorily and are reliable in operation, but they are complicated in construction and design and thus require a corresponding expenditure for the hydraulic piston-and-cylinder units and the control engineering circuits particularly required to control the chronological sequence of the individual lowering of the intermediate rolls or rollers.

SUMMARY OF THE INVENTION

Therefore, with the foregoing in mind, it is a primary object of the present invention to provide a new and improved construction of an apparatus for neutralizing overhanging or cantilever loads and which does not suffer from the aforementioned drawbacks and shortcomings of the prior art constructions.

Another and more specific object of the present invention aims at providing a new and improved apparatus for neutralizing overhanging and cantilever loads and which is very simple in construction and design, requires a minimum constructional expenditure and still affords absolute reliability in operation.

Yet a further significant object of the present invention is directed to a new and improved apparatus for neutralizing overhanging or cantilever loads, which apparatus requires a minimum of space and practically no maintenance and is not readily subject to malfunction or breakdown.

Now in order to implement these and still further objects of the invention, which will become more readily apparent as the description proceeds, the apparatus for neutralizing overhanging or cantilever loads of the present invention is manifested, among other things, by the features that means, such as movable, dimensionally deformable or displaceable means are provided for generating and setting the force which compensates for the overhanging or cantilever loads so that, upon opening the calender by lowering in each case the lower roll of respective coacting rolls, a force greater than the set force acts upon the apparatus for neutralizing the overhanging or cantilever loads. The load neutralizing apparatus moves, dimensionally deforms or displaces, as the case may be, the movable, dimensionally deformable or displaceable means, respectively. In this manner, a displacement path of the related roll into a lower or lowered position is rendered possible without external control or regulation action, and the displacement path into the lower lowered position is limited by means of a suitable limit stop or buffer or impact member or equivalent structure.

The movable means advantageously comprise a pivotably suspended and substantially horizontal two-armed beam or lever which is loadable at one arm thereof with weights, the other arm thereof serving to act upon the associated roll suspension.

In a second embodiment of the movable means which compensate for the overhanging or cantilever loads, there is provided a weight which acts upon the associated roll suspension constructed in the form of a double-armed lever or lever member which contains a pivot or fulcrum. This weight acts upon the arm located beyond the pivot or fulcrum and remote from the other arm supporting the associated roll.

The dimensionally deformable means advantageously comprise a spring assembly which possesses a linear spring characteristic.

In a further exemplary embodiment of the apparatus for neutralizing overhanging or cantilever loads, the dimensionally deformable means constitute an air cushion or pneumatic spring.

In a still further exemplary embodiment of the apparatus for neutralizing overhanging or cantilever loads, the dimensionally deformable means constitute a rubber buffer provided with a support or carrier which is elevationally adjustable at the roll stand.

The displaceable means which compensate for the overhanging or cantilever loads advantageously may comprise a cylinder having a column or head of liquid which is supported by means of a gas or air cushion. A conventional damping or throttling arrangement is advantageously attached at the cylinder to prevent any possible arising oscillations or fluttering in the system.

During the opening process or operation subsequent to the lowering of the lowermost roll or roller, the full weight of the roll section or surface covered by the treated material web additionally acts in each case upon the related apparatus for neutralizing the overhanging or cantilever loads. In other words, there is a far greater downwardly acting force than the force set in the related apparatus for neutralizing the overhanging or cantilever loads. This overload, as the case may be, compresses or moves, dimensionally deforms or displaces the actively supporting parts or portions of the apparatus until the desired or predetermined lowered position is reached. This lowering of the rolls or rollers is accomplished practically at the gravitational rate of fall or drop of the rolls or rollers and, furthermore, automatically without any control or switching action.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

.

DETAILED DESCRIPTION OF THE PREFERRED EMBODIMENTS

Figure 1:
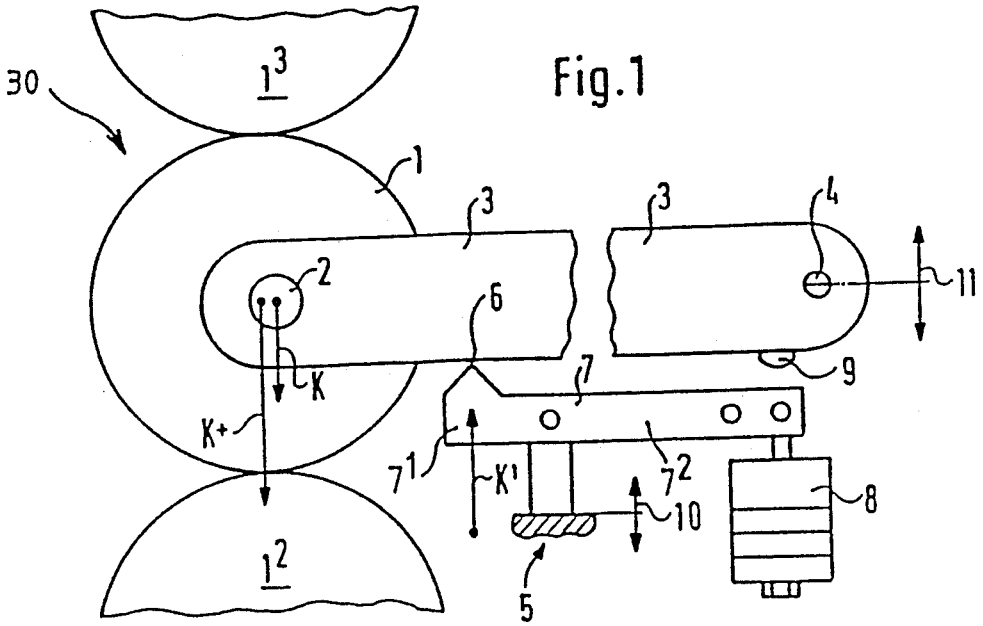
FIG. 1 schematically shows a first exemplary embodiment of the apparatus for neutralizing overhanging or cantilever loads and which is constructed according to the invention and arranged at a roll or roller in a calender.

Describing now the drawings, it is to be understood that to simplify the showing thereof, only enough of the construction of the apparatus for neutralizing overhanging or cantilever loads has been illustrated therein as is needed to enable one skilled in the art to readily understand the underlying principles and concepts of this invention. Turning attention now specifically to FIG. 1 of the drawings, an apparatus 5 for neutralizing overhanging or cantilever loads illustrated therein by way of example and not limitation is supported at a conventional roll stand or at a displaceable support or carriage, neither of which is particularly shown in the drawings.

An intermediate roll or roller 1 of a downwardly opening calender 30 is arranged between a lower roll or roller $\mathbf{1}^2$ and an upper roll or roller $\mathbf{1}^3$. The axle or journal 2 of the intermediate roll or roller 1 is mounted at an associated support arm or lever or lever member 3 which, in turn, is pivotably mounted at a pivot 4 provided at the roll stand or at the displaceable support or carriage, respectively.

In FIG. 1 the apparatus 5 for neutralizing overhanging or cantilever loads is conveniently depicted only from one side to facilitate the illustration and improve clarity thereof. It is to be understood that a mirror-image arrangement of that shown in FIG. 1 also is present at the oppositely situated side of the roll calender or calender 30.

The apparatus 5 for neutralizing overhanging or cantilever loads presses from below against the support arm or lever or lever member 3 of the appropriately positioned intermediate roll or roller 1 at a location or area 6, which lies as close as possible to the axle or journal 2 of the intermediate roll or roller 1, and with a force K′ which is of a magnitude that, for example, in accordance with the lever principle the overhanging or cantilever loads are compensated for or neutralized. Such overhanging or cantilever loads act in downward direction upon the axle or journal 2 as indicated in FIG. 1 by the arrow K. The neutralizing force K′ acting from or in the apparatus 5 is generated and/or set by either movable, positionally deformable or displaceable means.

When upon opening of the calender 30 the lower roll or roller $\mathbf{1}^2$ falls in the downward direction, there prevails a force K+ which is greater than the neutralizing force K′ transmitted by the apparatus 5 to the intermediate roll or roller 1 and which force K+ acts against the apparatus 5 such that the set neutralizing force K′ is overcome. In this manner, there is provided or given a displacement path of the intermediate roll or roller 1 into a lower lowered position.

This is particularly clearly depicted in FIG. 1. The force K′ for neutralizing the overhanging or cantilever loads is generated by a pivotably supported and substantially horizontally arranged double- or two-armed lever or beam 7. This two-armed lever or beam 7 presses with one arm $7^1$ thereof at the location or area 6 against the support arm or lever or lever member 3 by means of the force K' which neutralizes the overhanging or cantilever loads and which is generated by a weight 8 suspended at the other arm $7^2$ of the two-armed lever or beam 7. When the lower roll or roller $1^2$ is lowered upon downward opening of the calender 30, the force K+ overcomes the set neutralizing force K' of the apparatus 5 and downwardly presses that arm $7^1$ of the two-armed lever or beam 7 which presses against the location or area 6. The other arm $7^2$ of the two-armed lever or beam 7 is raised until it comes to rest at a stop or impact member or buffer 9. The intermediate roll or roller 1 is thus in the predetermined lowered position. It is evident that the limit stop or impact member or buffer 9 can be also directly arranged at the roll stand.

It should be noted that, as known to the art, the apparatus 5 for neutralizing overhanging or cantilever loads and the support arm or lever or lever member 3 are preferably arranged to be elevationally displaceable at the roll stand of the calender, for example, at the conventional displaceable support or carriage not particularly shown in the drawings. It is also known to the art to provide a separate as well as a mutual elevational adjustment for components or parts such as the apparatus 5 for neutralizing overhanging or cantilever loads and the support arm or lever or lever member 3.

Figure 2:
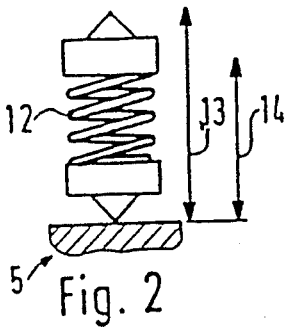
FIG. 2 schematically shows a second exemplary embodiment of the apparatus constructed according to the invention.

The apparatus 5 depicted in FIG. 2 comprises a spring assembly or spring bank or pile 12 which preferably possesses a linear spring characteristic. It is readily conceivable that, upon lowering of the rolls or rollers, the spring assembly or spring bank or pile 12 is compressed from a height 13 to a smaller height 14. In such case, a stop or buffer or impact member to limit the displacement path of the related intermediate roll or roller 1 would not be necessary, because the compression path of the spring assembly or spring bank or pile 12 as caused by the total weight of the related intermediate roll or roller 1 together with additional loads or weights amounts to or defines the displacement path of the related roll or roller 1 to the lowered position thereof. However, this displacement path or stroke limitation by the spring assembly or spring bank or pile 12 itself is an exceptional case. Generally, a separate stop or buffer or impact member should be provided.

Figure 3:
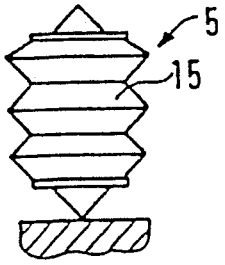
FIG. 3 schematically shows a third exemplary embodiment of the apparatus constructed according to the invention.

Similar possible force generation means comprise an air or pneumatic spring 15 shown in FIG. 3 as a further embodiment of the apparatus 5 for neutralizing overhanging or cantilever loads.

Figure 4:
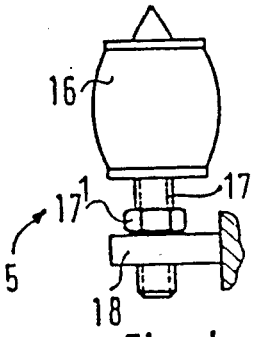
FIG. 4 schematically shows a fourth exemplary embodiment of the apparatus constructed according to the invention.

In FIG. 4 there is depicted a rubber buffer 16 in a still further variant of the apparatus 5 for neutralizing overhanging or cantilever loads. This apparatus 5 is elevationally adjustable with respect to a support or support member 18 by means of a set screw or threaded bolt or threaded shank 17 or the like which cooperates with an adjusting or locking nut $17^1$. In this manner, the neutralizing force K' is also adjustable. Such a set screw or threaded bolt 17 or the like would be also advantageous for the apparatus 5 provided with the spring assembly or spring bank or pile 12 or for the apparatus 5 provided with the air or pneumatic spring 15.

Figure 5:
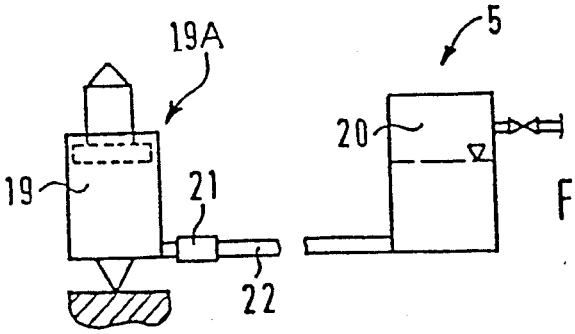
FIG. 5 schematically shows a fifth exemplary embodiment of the apparatus constructed according to the invention.

In FIG. 5 the means generating the force K' which compensates for overhanging or cantilever loads is a column or head of liquid 19 which is defined in a piston-cylinder unit 19A and supported by means of a compressible gas cushion 20. At a line or conduit 22 for the liquid there can be provided a conventional damping or throttling device 21 in order to dampen any possibly arising oscillations or fluttering in the system. It is important to note that the adjusted or set neutralizing force K' in the inventive apparatus 5 does not require re-adjustment, so that when the calender is again closed, i.e. upon raising the intermediate roll or roller 1 into the working or operational position thereof, such neutralizing force K' need not be adjusted or set anew.

It is readily conceivable that an air or pneumatic spring 15 could be replaced, for example, by a spring assembly 12.

The elevational adjustment of the support or carriage of the apparatus 5 as well as of the support or carriage of the pivot 4 of the support arm or lever or lever member 3 is of importance in cases where the intermediate rolls or rollers 1 undergo, during operation, a change or alteration in diameter due to wear or abrasion and the worn-down rolls or rollers are replaced by new or reground rolls or rollers. Under such circumstances, the distance or spacing of the support arm or lever or lever member 3 to the apparatus 5 alters or changes, and likewise the adjusted or set force K' for neutralizing overhanging or cantilever loads no longer corresponds with the new spatial situation. However, in case the apparatus 5 as well as the pivot or pivot means 4 of the support arm or lever or lever member 3 are arranged at a mutual sliding support or carriage (not shown) which is elevationally adjustable along the roll stand of the calender 30, then the force K' adjusted or set in the apparatus 5 can remain automatically of the same magnitude after accomplishing the elevational adjustment.

Other known arrangements for elevational adjustment of such support locations serve the same purpose. This is schematically illustrated in FIG. 1 by the double-headed arrows 10 and 11.

It is of importance to note that the smaller the width of a material web is between the rolls or rollers which form the nip and have a predetermined length, the greater the overhanging or cantilever loads are and the greater the neutralizing force K' has to be set in the related apparatus 5 for neutralizing overhanging or cantilever loads. In other words, the force which compensates for said overhanging loads is variably adjustable such that said force increases the greater the distance is from the edges of the treated material web to respective sides or ends of the related roll.

The overhanging or cantilever loads on both sides of such a narrow material web are larger by the weight of the roll parts or portions located between the web edges and the respective roll ends.

Figure 6:
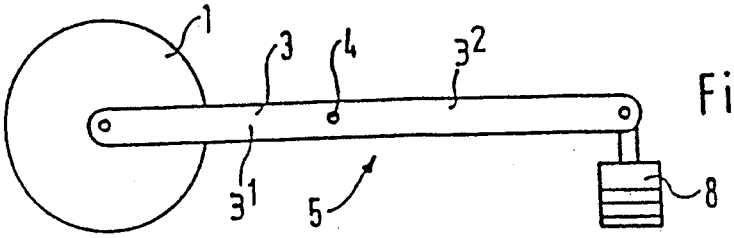
FIG. 6 schematically shows a sixth exemplary embodiment of the apparatus constructed according to the invention.

A further exemplary embodiment of the apparatus 5 is depicted in FIG. 6. The support arm or lever or lever member 3 possesses the form or shape of a double- or two-armed lever or lever member. A first arm $3^1$ of this two-armed lever or lever member 3 supports the associated intermediate roll or roller 1, while the other or second arm $3^2$ supports a weight $8^1$ behind or beyond the pivot or pivot means 4.

Further constructional variants of the apparatus 5 are conceivable as combinations of the exemplary embodiments already explained hereinbefore, for example, a spring assembly 12 together with an air or pneumatic spring cushion 15, a spring assembly 12 together with a rubber buffer 16 and finally a spring assembly 12 together with the cylinder containing a column or head of liquid 19.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for neutralizing respective overhanging loads at a roll of a calender which is to be downwardly opened, which apparatus is supported at a stand of the calender, provided at each of two sides of the roll and presses against respective roll suspensions in a predetermined position of the roll with a compensating force which compensates for the respective overhanging loads, comprising:

means for generating and setting the compensating force which compensates for the overhanging loads of the roll, said means for generating and setting said compensating force including displaceable means, said displaceable means including a piston-cylinder unit having a head of liquid which is supported by means of a gas cushion;

said roll assuming an operative position during operation of the calender;

said roll being downwardly displaced into an inoperative position downward of said operative position upon opening of said calender;

said roll, during said downward displacement into said inoperative position, generating a downward force which opposes and is greater than said compensating force;

said means for generating and setting said compensating force being coupled to a respective side of said roll and acted upon by said greater downward force generated by said roll upon opening of the calender, for permitting said downward displacement of said roll into said inoperative position without external control action;

stop means; and said travel of the related roll into said inoperative position being limited by said stop means.

2. The apparatus as defined in claim 1, wherein:

said roll forming conjointly with a lower roll disposed beneath said roll in cooperating relationship therewith, a nip for processing a material web passed through said nip during operation of said calender;

said material web having a predetermined width defined between lateral edges of said material web; and said compensating force which compensates for said overhanging loads being variably adjustable such that said compensating force increases the greater the distance from the lateral edges of said material web to respective sides of the roll.

3. An apparatus for neutralizing overhanging loads at a roll of a calender which is to be downwardly opened, which apparatus is supported at a stand of the calender, provided at each of the two sides of the roll and presses against respective roll suspensions in a predetermined position of the roll with a force which compensates for the overhanging loads, comprising:

means for generating and setting the force which compensates for the overhanging loads;

said roll generating a downward force which acts against the apparatus upon opening of the calender by lowering a lower roll coacting with said roll and located below said roll;

said downward force being greater than said force generated and set by said means and influencing said means such that a displacement path of the roll into a lowered position is rendered possible without external control action;

stop means;

said travel of the roll into said lowered position being limited by said stop means;

said means for generating and setting said force comprise displaceable means;

said downward force displacing said displaceable means such that said displacement path of the roll into said lowered position is rendered possible without said external control action;

said displaceable means comprising a piston-cylinder unit having a head of liquid which is supported by means of a gas cushion; and a damping device provided at a cylinder of said piston-cylinder unit for throttling liquid flow into and out of said cylinder and thereby damping oscillations.

4. An apparatus for neutralizing overhanging loads at a roll of a calender which is to be downwardly opened, which apparatus is supported at a stand of the calender, provided at each of two sides of the roll and presses against respective roll suspensions in a predetermined position of the roll with a compensating force which compensates for the overhanging loads, comprising:

means for generating and setting the compensating force which compensates for the overhanging loads of the roll, said means for generating and wetting the compensating force including a piston-cylinder unit having a head of liquid which is supported by means of a gas cushion;

said roll assuming an operative position during operation of the calender;

said roll being downwardly displaced into an inoperative position downward of said operative position upon opening of said calender;

said roll, during said downward displacement into said inoperative position, generating a downward force which opposes and is greater than said compensating force; and said means for generating and setting said compensating force being coupled to a respective side of said roll and acted upon by said greater downward force generated by said roll upon opening of the calender, for permitting said downward displacement of said roll into said inoperative position.

* * * * *